US007065804B2

(12) United States Patent
Rickman

(10) Patent No.: US 7,065,804 B2
(45) Date of Patent: Jun. 27, 2006

(54) POOL COVER DRAIN SYSTEM

(76) Inventor: Kevin A. Rickman, 39 Lalla La., Mayfield, KY (US) 42066

( * ) Notice: Subject to any disclaimer, the term of this patent is extended or adjusted under 35 U.S.C. 154(b) by 42 days.

(21) Appl. No.: 10/776,880

(22) Filed: Feb. 11, 2004

(65) Prior Publication Data

US 2005/0172390 A1 Aug. 11, 2005

(51) Int. Cl.
*E04H 4/00* (2006.01)

(52) U.S. Cl. ..... 4/498

(58) Field of Classification Search ..... 4/498; 220/119

See application file for complete search history.

(56) References Cited

U.S. PATENT DOCUMENTS

| | | | | |
|---|---|---|---|---|
| 1,857,362 | A * | 5/1932 | Day | 220/219 |
| 3,184,764 | A | 5/1965 | West | |
| 3,579,657 | A * | 5/1971 | Gurrieri | 4/490 |
| 4,318,421 | A | 3/1982 | Ward | |
| 4,819,681 | A | 4/1989 | Hodak | |
| 4,834,138 | A | 5/1989 | Dellasso | |
| 4,851,275 | A | 7/1989 | Yes | |
| 4,853,984 | A | 8/1989 | Celiano | |
| 5,259,078 | A * | 11/1993 | Crandall | 4/503 |
| 5,594,960 | A * | 1/1997 | Stern | 4/498 |
| 5,802,629 | A | 9/1998 | Zietek | |
| 5,946,743 | A | 9/1999 | Hashmi | |
| 6,128,791 | A | 10/2000 | Brocking | |
| 6,260,217 | B1 | 7/2001 | Loft, Jr. | |
| 6,487,733 | B1 | 12/2002 | Bonelli et al. | |
| 2002/0116755 | A1 | 8/2002 | Bonelli et al. | |
| 2003/0037371 | A1 | 2/2003 | Shaw | |
| 2003/0079279 | A1 | 5/2003 | Bonelli et al. | |

* cited by examiner

*Primary Examiner*—Charles E. Phillips
(74) *Attorney, Agent, or Firm*—Wyatt, Tarrant & Combs, LLP

(57) ABSTRACT

The present invention generally relates to an assembly and related methods for draining water from atop a pool cover. The invention may be said to include a pool cover that has an aperture defined therein and a drain assembly attached to the pool cover and associated with the aperture of the pool cover. The drain assembly of the invention generally includes a debris filter and/or appropriate drain cover to enable water from atop the pool cover to enter the drain assembly and be transported at least generally away from the pool. In addition, the drain assembly is generally designed/configured to exhibit a weight sufficient to position at least a portion of debris filter/drain cover at or below a water level of the pool with which it is being utilized to further drainage capabilities.

13 Claims, 6 Drawing Sheets

POOL COVER DRAIN SYSTEM

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention generally relates to swimming pool covers and, more particularly, to a swimming pool cover that provides for the drainage of water from its surface.

BACKGROUND OF THE INVENTION

Swimming pools of both the in-ground and above-ground type are generally kept filled with water year-round. Most swimming pools are typically provided with flexible covers that prevent falling or windblown leaves and other kinds of debris from contaminating the water remaining in the pool. In other words, the cover ideally keeps the pool water relatively clean and free of extraneous matter. This greatly facilitates the preparation of the pool for the resumption of swimming.

In addition to debris, significant amounts of water from rain or melted snow can accumulate on the surface of conventional swimming pool covers. As such, before the cover can be taken off of the pool, the bulk of the water must be laboriously removed, while attempting to prevent any debris deposited on the surface from falling into the pool. This task of removing the precipitation that has collected on top of the cover may generally consist of weighting down a vacuum hose or the like and positioning the same on the center of the top surface of the pool cover to remove the water therefrom. This water removal process can be complicated by the presence of leaves and other debris in the water that may clog the vacuum hose when attempting to remove the water from the pool cover. The clogging of the vacuum hose generally requires the vacuum source to be shut off so that the hose can be cleared of any debris followed by continuing the water removal process. As may be evident from the above description, this water removal process can be time-consuming as well as labor-intensive.

In addition to the problems associated with removal of water from the pool cover, stress imposed on the pool cover by the weight of the accumulated water thereon can be so great as to cause the pool cover to tear, stretch, and/or rupture, resulting not only in the destruction of the pool cover, but also in the possible contamination of the pool water. Further, the accumulation of water on the pool cover can make the pool cover sag and may tend to force pool water out of the pool, such as through a skimmer basket of the pool. As a result, this incidental loss of water due to use of a conventional pool cover may necessitates a refilling of the pool prior to the next use. Even further, the accumulation of water and/or debris on the pool cover can result in difficulties when it comes time to clean the pool cover.

SUMMARY OF THE INVENTION

Accordingly, it is an object of the present invention to provide a pool cover drain assembly that is at least generally self-draining. It is another object of the invention to provide a pool cover drain assembly that at least generally prevents accumulated water and debris from contaminating the pool water. It is still another object to provide a pool cover drain assembly that enables draining of water therefrom when debris is associated with the water. It is yet another object to provide a pool cover drain assembly that alleviates a need to supplement pool water with additional water as a result of using the pool cover drain assembly. These objects, as well as others, may be met by the following invention.

In a general sense, the present invention relates to a pool cover assembly having a drain assembly associated therewith that is sufficiently weighted such that the drain assembly is located at substantially the lowest portion of the pool cover assembly when installed on a pool. In one aspect, the invention is directed to a pool cover having a hole in it and a drain assembly attached to the pool cover in a manner that enables a debris filter of the drain assembly to be disposed at least generally within the hole of the pool cover. Another aspect of the invention is directed to a pool cover assembly that includes a drain assembly attached to a pool cover. This drain assembly generally exhibits a weight sufficient to position at least a portion of an associated drain cover at or below a water level of a pool with which it is utilized. Still another aspect of the invention is directed to a pool cover assembly that includes a pool cover and a drain assembly. This drain assembly includes a basin interconnected with a debris filter. Further, an aperture in the pool cover and at least a portion of the pool cover itself are disposed between the debris filter and basin. Yet further, a weight density of the drain assembly of this aspect is generally greater than that of water.

Various refinements may exist of the features noted in relation to the above-disclosed aspects of the present invention. Further features may also be incorporated in these aspects of the present invention as well. These refinements and additional features may exist individually or in any combination. Moreover, each of the various features discussed herein in relation to one or more of the illustrated embodiments of the present invention may generally be utilized by any of the aspect(s) of the present invention, alone or in any combination.

DETAILED DESCRIPTION OF THE DRAWINGS

Figure 1:
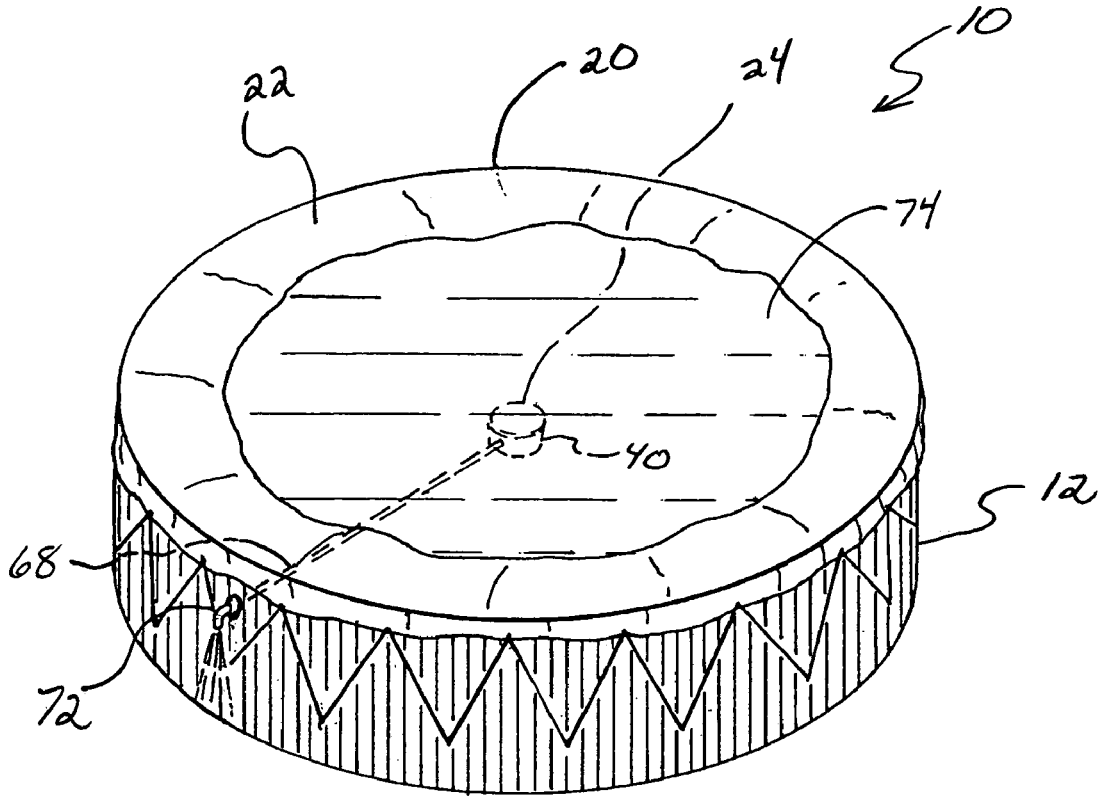
FIG. 1 is a perspective view of a pool assembly including a pool cover drain assembly.
Figure 2:
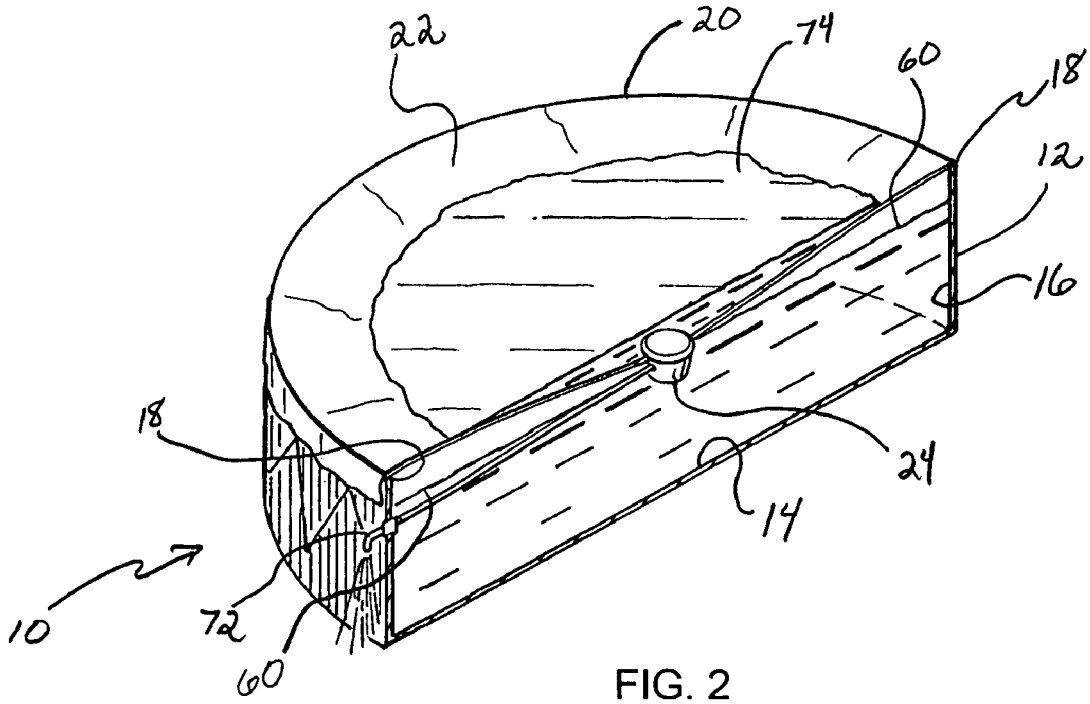
FIG. 2 is a cut-away view of the pool assembly of FIG. 1.

The present invention will now be described in relation to the accompanying drawings, which at least assist in illustrating the various pertinent features thereof. FIGS. 1–2 show an above-ground pool assembly 10 including a pool 12 and a pool cover assembly 20 positioned at least generally atop the pool 12. More particularly, FIG. 2 shows that the pool 12 of the pool assembly 10 includes a floor 14, a side wall 16, and an upper rim 18. In the arrangement shown in FIG. 1, the side wall 16 may be said to be disposed between the floor 14 and the upper rim 18 of the pool 12. It should be noted that while the following pool cover assembly 20 is described in relation to the pool 12, various embodiments of the pool cover assembly 20 may be appropriate for use in combination with pools of numerous designs and configurations. For instance, some embodiments of the pool cover assembly 20 may be appropriate for use with in-ground pools. In any event, the pool cover assembly 20 of the pool assembly 10 shown in FIGS. 1–2 includes a pool cover 22 and a drain assembly 24 attached to the pool cover 22. This pool cover 22 is positioned so that the rim 18 of the pool 12 is generally disposed between at least a portion of the pool cover 22 and the side wall 16 of the pool 12.

Figure 3:
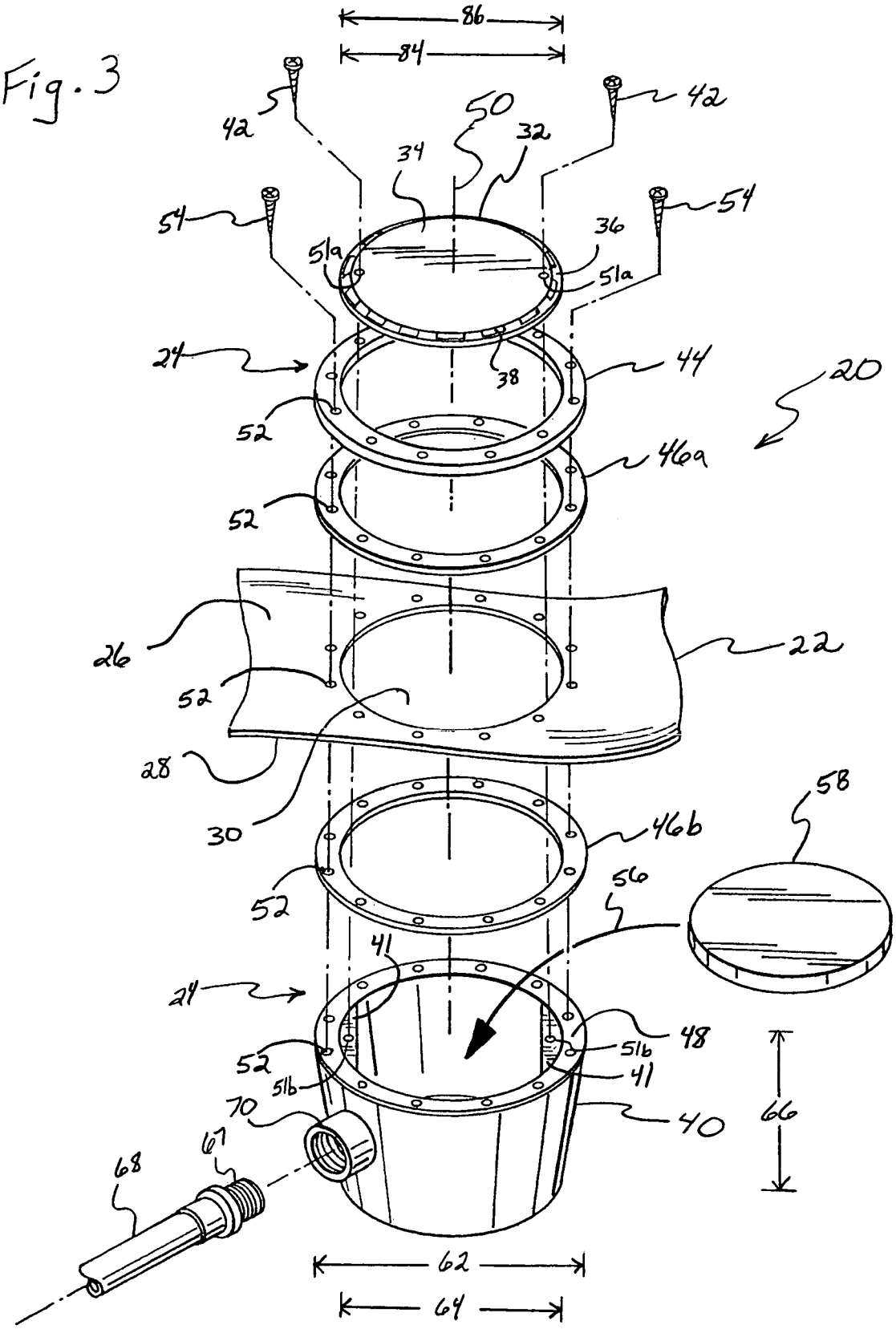
FIG. 3 is an exploded view of the pool cover drain assembly of FIG. 1.

FIG. 3 illustrates that the drain assembly 24 of the pool cover assembly 20 includes a drain cover 32 that is interconnectable with a basin 40 of the drain assembly 24 via a plurality of mechanical fasteners 42. This drain cover 32 has a substantially flat top surface 34 and a side wall 36 that includes a plurality of drainage holes 38. While the top surface 34 of the drain cover 32 is shown as being substantially flat, other designs of the top surface 34 may be appropriate. Further, although the drainage holes 38 of the drain cover 32 are shown as being defined in the side wall 36, other embodiments of the drain cover 32 may include drainage holes 38 extending through just the top surface 34 or both the top surface 34 and the side wall 36. In addition, while the drainage holes 38 are illustrated as being substantially rectangular in shape, other embodiments of the pool cover assembly 20 may include a drain cover 32 having drainage holes 38 of any appropriate shape, size, and/or design. Incidentally, this drain cover 32 may be made of any suitable material, such as polyvinyl chloride, plastic, or non-corrosive metal.

In addition to the drain cover 32, the drain cover assembly 24 shown in FIG. 3 includes a support retainer 44 and first and second gaskets 46*a*, 46*b* (respectively). More particularly, the first gasket 46*a* is generally disposed between the support retainer 44 and a top surface 26 of the pool cover 22. Further, the second gasket 46*b* is generally positioned between a top 48 of the basin 40 and a bottom surface 28 of the pool cover 22. The support retainer 44, gaskets 46*a*–*b*, pool cover 22, and basin 40 are generally oriented, relative to a longitudinal reference axis 50 of the drain assembly 24, in an alignment that provides a common throughway. In other words, those components of the drain assembly 24 are generally arranged so that water can enter the drain assembly 24 via the drain cover 32 and travel via the throughway to the basin 40 of the drain assembly 24. Moreover, the support retainer 44, gaskets 46*a*–*b*, pool cover 22, and basin 40 are preferably oriented, relative to each other, so that fastener holes 52 in each of the same are substantially aligned. This alignment of the fastener holes 52 generally enables appropriate fasteners 54 to be extended therethrough and at least assist in interconnecting the support retainer 44, gaskets 46*a*–*b*, pool cover 22, and basin 40.

Still with regard to FIG. 3, it should be noted that some embodiments of the pool cover assembly 20 may utilize an appropriate sealant/adhesive in place of or in addition to one or both of the first and second gaskets 46*a*–*b*. Further, some embodiments of the pool cover assembly 20 may employ other manners of interconnecting the support retainer 44 with the pool cover 22 and/or the basin 40 than utilizing the fasteners 54. For instance, adhesives, clamps, welds, and/or other appropriate fastening mechanisms may be utilized instead of or in addition to the fasteners 54 in some embodiments.

The pool cover assembly 20 of FIG. 3 is generally designed so that an inner aperture diameter 84 of at least one of, and preferably all of, the support retainer 44, gaskets 46*a*–*b*, pool cover 22, and basin 40 is substantially equal to or slightly greater than an outer diameter 86 of the drain cover 32. This arrangement enables the drain cover 32 to fit at least generally within an aperture 30 in the pool cover 22 and abut cover supports 41 of the basin 40. Accordingly, it may be said that when the pool cover assembly 20 is assembled, at least a portion of the drain cover 32 extends through the aperture 30 in the pool cover 22 and is disposed beyond the bottom surface 28 of the pool cover 22. In a variation of this embodiment, the outer diameter 86 of the drain cover 32 may be configured so that the same may releasably snap in and out of engagement with an appropriately designed inner aperture diameter 84 of at least one of the support retainer 44 and basin 40. As illustrated, at least a portion of the drain cover 32 preferably extends beyond or at least generally sticks out from the top surface 26 of the pool cover 22. One benefit of this feature is that it facilitates a drying of debris that cannot make it through the openings 38 in the drain cover 32 by potentially exposing at least some debris to airflow above the pool cover 22. This feature at least generally enhances the chances that such debris may dry and/or be carried away by airflow (e.g., from wind, a leaf blower, or the like).

As indicated by arrow 56 of FIG. 3, disposable at least generally within the basin 40 of the drain assembly 24 is a dead weight 58. Herein, "dead weight" refers to something that serves no significant purpose/function in the drain assembly 24 but to add weight to the same. This dead weight 58 may be any appropriate material and preferably exhibits a weight sufficient to enable at least a portion of the drain cover 32 to be positioned at or below a water level 60 of the pool 12 (FIG. 2). In other words, this dead weight 58 generally exhibits a weight that provides the drain assembly 24 with a weight density greater than that of water. So, for example, if the basin 40 has a top diameter 62 of about 10 inches, tapers to a bottom diameter 64 of about 8 inches, and has a height 66 of about 6 inches, the drain assembly 24 may weigh between about 5 pounds and about 9 pounds, preferably between about 6 pounds and about 8 pounds, and more preferably may weigh about 7 pounds. It should be noted that any appropriate size, dimensions, and design of the basin 40 may be utilized in the drain assembly 24. Moreover, it should be noted that the dead weight 58 may exhibit any appropriate weight to provide the drain assembly 24 with a weight density greater than that of water. Yet further, depending on the materials utilized to make the drain assembly 24, some embodiments may not include a dead weight 58 such as if the weight density of the drain assembly 24 is already greater than that of water without the inclusion of the dead weight 58.

Figure 4:
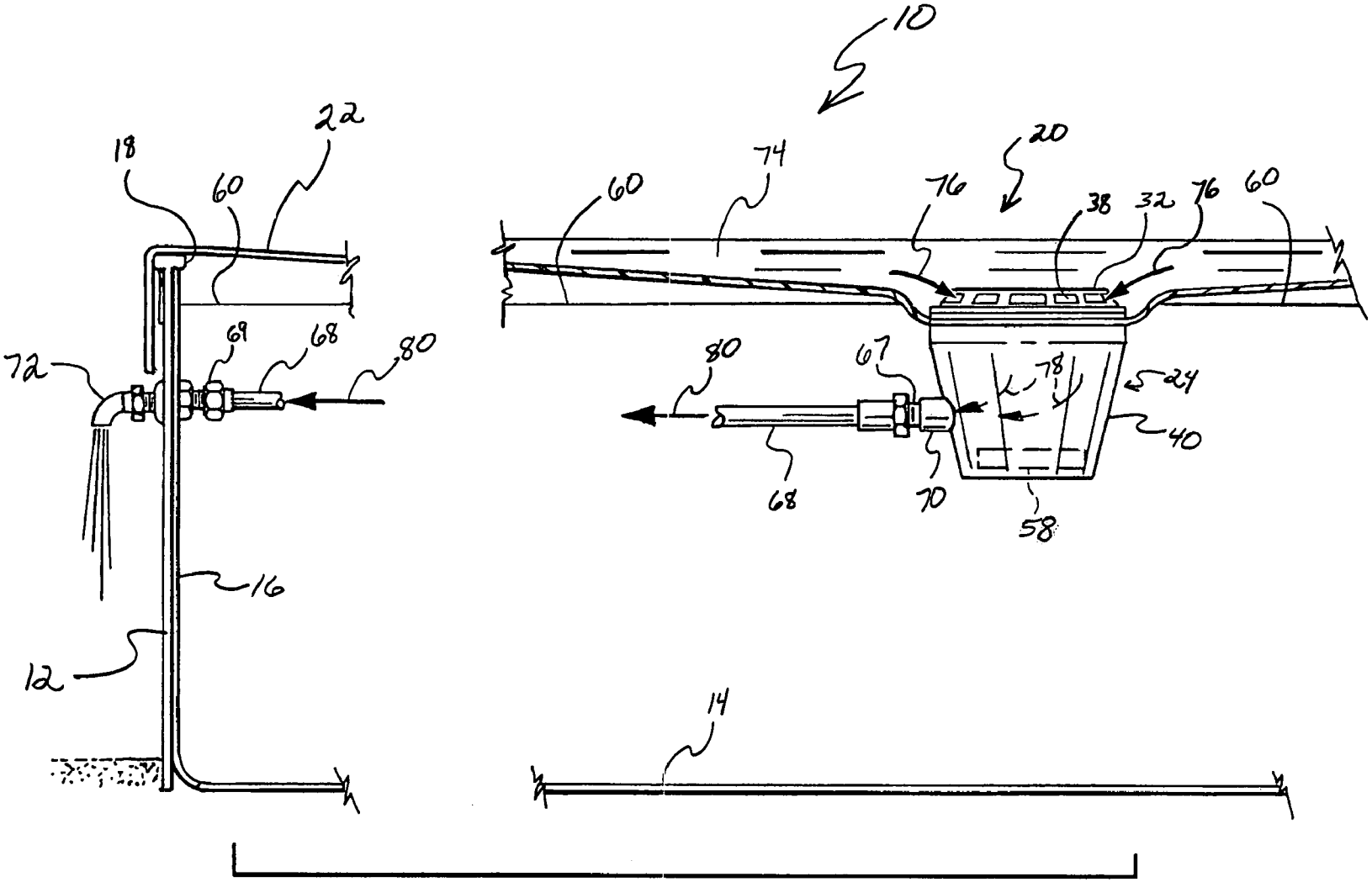
FIG. 4 is a magnified side view of the pool assembly of FIG. 1.

Referring to FIGS. 3 and 4, the drain assembly 24 also includes a drainage conduit 68. More particularly, a first end 67 of the drainage conduit 68 is interconnected with an out port 70 of the basin 40. While the drainage conduit 68 and the out port 70 are illustrated as being interconnectable via complimentarily configured threads, other embodiments may exhibit any of a number of other appropriate manners of interconnecting the drainage conduit 68 and the out port 70 of the basin 40. The out port 70 of the basin 40 is located about midway up the height 66 of the basin 40. This may provide a benefit of allowing water to collect in a lower portion of the basin 40 to at least generally assist in leveling the drain cover 32 and/or desirably add to a total weight of the drain assembly 24. It should be noted that other embodiments of the basin 40 may include the out port 70 being located at other appropriate locations on the basin 40.

The drainage conduit 68 of the drain assembly 24 of FIG. 4 may be made of any appropriate material, but is preferably made of a material that exhibits a weight density greater than that of water. This preferential design beneficially prevents the drainage conduit 68 from floating up toward the water level 60 of the pool 12. In one preferred embodiment, the drainage conduit 68 is made of an at least generally flexible material. FIG. 4 shows that a second end 69 of the drainage conduit 68 is interconnected with a port 72 of the pool 12. In one embodiment, this port 72 may serve as a water inlet to the pool 12 when the drainage conduit is not interconnected with the same. For instance, in the winter months, a water supply may be disconnected from the port 72, and a drain hose (not shown) or other appropriate conduit, in addition to the second end 69 of the drainage conduit 68, may be connected to the port 72 to at least generally direct the water 74 out of and away from the pool assembly 10.

As shown in FIG. 4, due to the weighting of the drain assembly 24, water 74 from atop the pool cover assembly 20 flows along the pool cover 22 in the general directions indicated by arrows 76 toward the drain assembly 24. The water 74 enters the drain assembly 24 through the apertures 38 in the drain cover 32 and travels through the aperture 30 (FIG. 3) in the pool cover 22 into the basin 40. The water 74 then travels in the general directions indicated by arrows 78 out of the basin 40 via the out port 70 of the basin 40 and into the drainage conduit 68 of the drain assembly 24. In the general direction indicated by arrows 80, the water 74 travels through the drainage conduit 68 toward the port 72 of the pool 12. At the port 72 of the pool 12, the water 74 exists the pool assembly 10. Incidentally, it is preferred in at least one embodiment that the drainage conduit 68 is oriented such that the water 74 may travel at least generally "downhill." In other words, it is preferred that the drainage conduit 68 is oriented so that gravitational forces can at least generally facilitate the flow of the water 74 from the first end 67 of the drainage conduit 68 toward the second end 69 of the same.

While some embodiments of the pool cover assembly 20 of FIG. 4 may be provided already assembled, some embodiments may be directed to existing pool covers that may be modified to provide the pool cover assembly 20 of FIG. 4 (or any other pool cover assembly of the invention, for that matter). To incorporate the drain assembly 24 with an existing pool cover 22, the following protocol may be followed. The second gasket 46*b* may be placed on the top 48 of the basin 40, preferably so that the holes 52 in the second gasket 46*b* at least generally line up with the holes 52 in basin 40. In an additional step, a desired location on the pool cover 22 whereat the drain assembly 24 is to be attached to the same is determined. It is preferred that this location be a central location on the pool cover 22. The pool cover 22 (and preferably, the central portion thereof) may be placed atop the second gasket 46*b*, which rests atop the basin 40, and the first gasket 46*a* may be positioned on top of the pool cover 22 so that the pool cover 22 is disposed between the first and second gaskets 46*a–b*. It is preferred that the first and second gaskets 46*a–b*, as well as the holes 52 therein, are substantially aligned with one another. The support retainer 44 may then be placed on top of first gasket 46*a*, again, preferably so that corresponding holes 52 in the support retainer 44, gaskets 46*a–b*, and basin 40 are substantially aligned. A punch or the like may be inserted through a given hole 52 in the support retain 44 and the corresponding hole 52 in the first gasket 46*a* and may be used to create a corresponding hole 52 in the pool cover 22. One of the fasteners 54 may then be extended through the holes 52 in the support retainer 44, gasket 46*a*, pool cover 22, gasket 46*b*, and basin 40 and tightened. These steps may be repeated until the desired quantity of fasteners 54 are installed, and the drain assembly 24 is securely (and preferably, substantially water-tightly) attached to the pool cover 22. The aperture 30 in the pool cover 22 may then be cut, preferably to about the size of an upper opening in the basin 40.

Still referring to the protocol for modifying an existing pool cover 22, after the aperture 30 has been defined in the pool cover 22, the dead weight 58 may then be placed in the basin 40, and the drain cover 32 may be placed on the recessed cover supports 41 of the basin 40 so that fastener holes 51*a* in the drain cover 32 align with fastener holes 51*b* in the cover supports 41 of the basin 40. The fasteners 42 may then be placed in the appropriate holes 51*a–b* and tightened to secure the drain cover 32 to the basin 40.

In another step of the protocol, the first end 67 of the drainage conduit 68 (exhibiting a desired length) may be connected with the out port 70 of the basin 40, and the second end 69 of the drainage conduit 68 may be connected with the port 72 of the pool 12. These connections may be made in any appropriate manner including the use of threading, adhesive, mechanical fasteners, and the like. The pool cover assembly 20 may then be utilized to enable water from atop of the pool cover 22 to pass at least generally into the basin 40, through the drainage conduit 68 and out the port 72 of the pool 12. It should be noted that some protocols associated with the invention may include alternative arrangements of the above described steps. Moreover, other protocols for installing a drain assembly of the invention may not include some of the above steps and/or may include additional steps.

Figure 5:
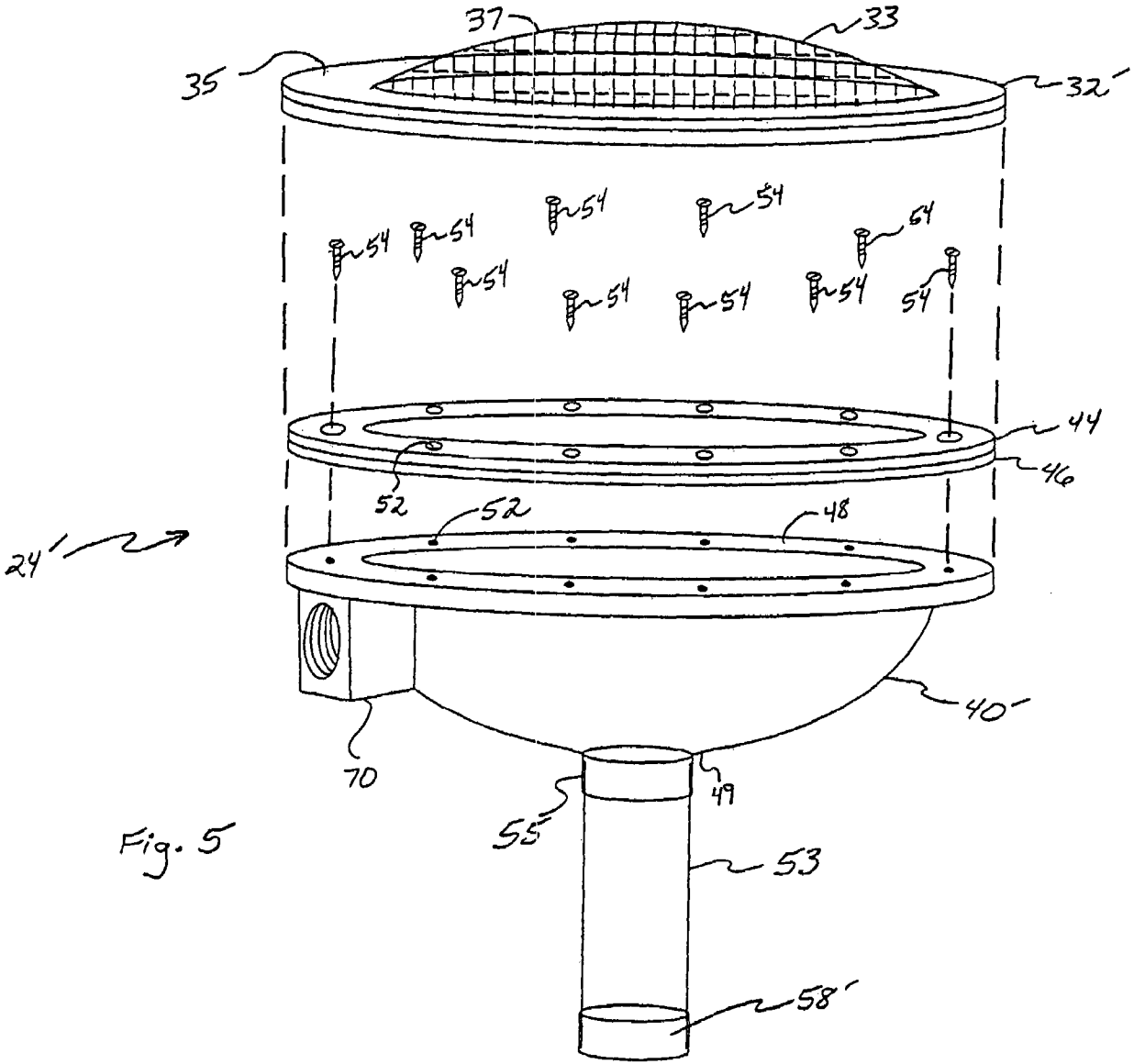
FIG. 5 is an exploded view of another embodiment of a pool cover drain assembly.

FIG. 5 illustrates another embodiment of the drain assembly 24, and accordingly, a "single prime" designation is utilized to identify the components of the drain assembly 24' of FIG. 5 that differ from those of drain assembly 24. It should be noted that unless otherwise described, the various features and description of the drain assembly 24 apply the drain assembly 24' of FIG. 5. Moreover, some embodiments of the invention may include combinations of the features of the drain assemblies 24, 24'.

The drain assembly 24' of FIG. 5 includes a drain cover 32' that is interconnectable with a basin 40' of the drain assembly 24'. More particularly, the drain cover 32' includes a screen 33 (or other appropriate debris filter) and a base 35 that is designed to releasably connect with one or both the support retainer 44 and the basin 40' of the drain assembly 24' in a snap-on fashion. The screen 33 includes a substantially convex side 37 and an opposing substantially concave side (not shown). However, it should be appreciated that numerous other designs and configurations of the screen 33 may be appropriate. Some embodiments of the drain assembly 24' may even include a drain cover 32 like that described in relation to FIG. 3.

The pool cover assembly 24' includes a support retainer 44 at least generally like that shown in FIG. 3 and at least one gasket 46. In one embodiment, the gasket 46 is generally disposed between the support retainer 44 and the pool cover 22 (not shown in FIG. 5). In addition, another gasket 46 may be generally positioned between a top 48 of the basin 40' and a the pool cover 22. These gaskets 46 are generally utilized to promote a water-tight sealing between the support retainer 44 and the pool cover 22 and also between the basin 40 and the pool cover 22. It should be noted that any other appropriate manners of providing a water-tight seal may be utilized in addition to or instead of one or more of the gaskets 46. In any event, the support retainer 44, gasket(s) 46, and basin 40 are generally oriented in an alignment that provides a common throughway for water to pass into the drain assembly 24' via the drain cover 32' and through to the basin 40'.

The basin 40' of the drain assembly 24' of FIG. 5 is shown as being at least generally bowl-shaped. It should be noted that other embodiments of the basin 40' may exhibit other appropriate designs. Attached to a bottom 49 of the basin 40' is a weight assembly 53. This weight assembly 53 includes an attachment portion 55 that may be at least generally utilized in connecting the weight assembly 53 to the bottom of the basin 40'. For instance, this attachment portion may include a threaded region complimentarily configured to engage a threaded region of the bottom 49 of the basin 40'. As another example, this attachment portion 55 of the weight assembly 53 may refer to a segment of the assembly 53 on which adhesive is placed to affix the assembly 53 to the basin 40'.

Also included in this weight assembly 53 shown in FIG. 5 is a dead weight 58' that may be any appropriate material and preferably exhibits a weight sufficient to enable at least a portion of the drain cover 32' to be positioned at or below a water level 60 of the pool 12 (FIG. 2). For example, this dead weight 58' may refer to one or more of sand, metals including but not limited to steel and lead, and the like. It should be noted that any appropriate size, dimensions, and design of the basin 40' may be utilized in the drain assembly 24'. Moreover, it should be noted that the weight assembly 53 may exhibit any appropriate weight to provide the drain assembly 24' with a weight density sufficient to position at least a portion of the drain cover 32' at or below water level when in use. It should also be noted that some embodiments of the drain assembly 24' may not include a weight assembly 53 such as if the weight density of the drain assembly 24' is already sufficient to position the drain cover 32' at or below water level when in use without the inclusion of the weight assembly 53.

An alternative embodiment of the drain assembly 24' may include a deadweight similar to the deadweight 58 of FIG. 3. In such an embodiment, an underside of the deadweight may be shaped to approximate an internal contour of the basin 40' of the drain assembly 24'.

Some embodiments of the basin 40' of FIG. 5 include numerous appropriate locations for the out port 70 of the basin 40' other than that shown in FIG. 5. For instance, the out port 70 of the basin 40' may be located more toward the bottom 49 of the basin 40' in another embodiment.

Figure 6:
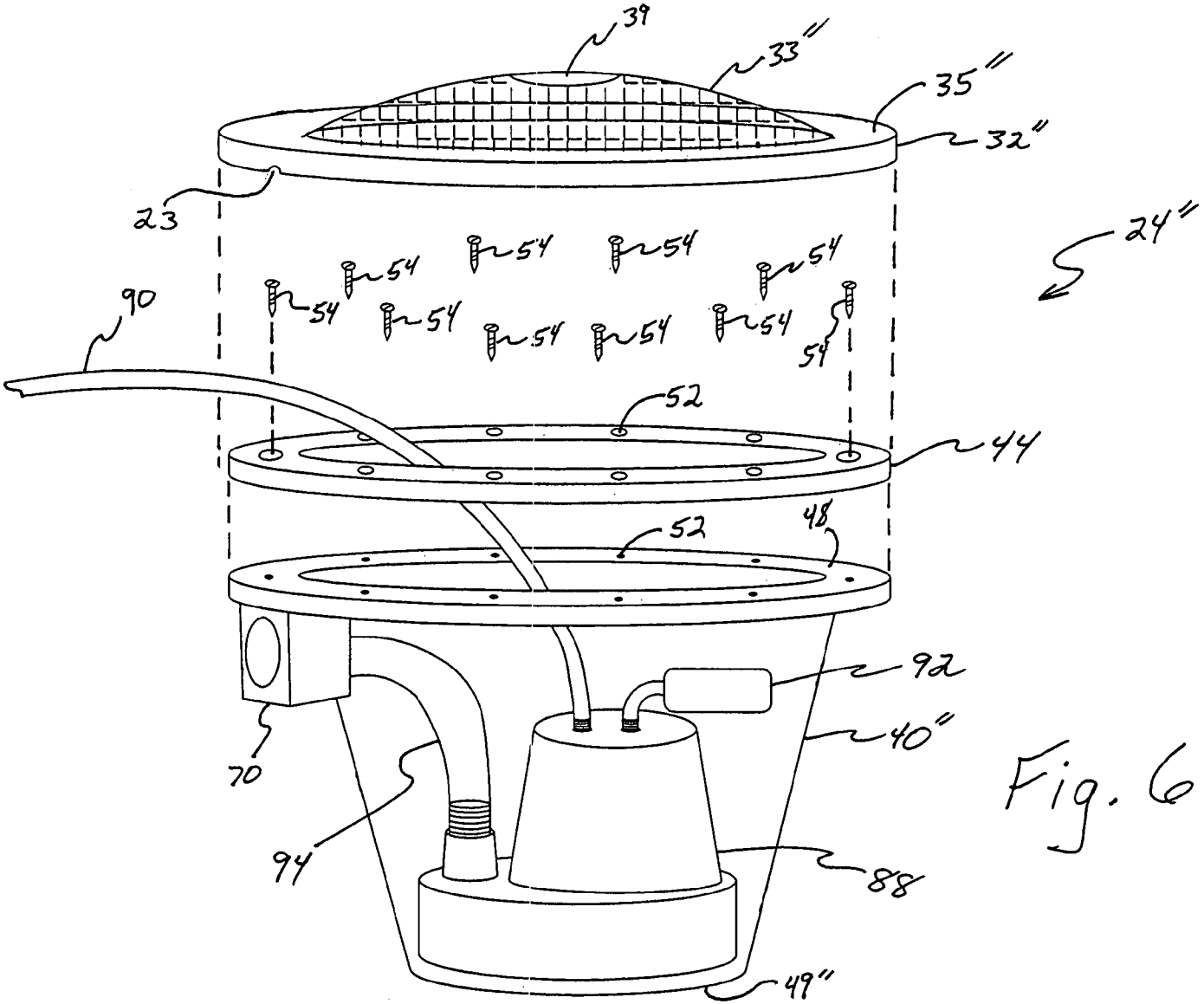
FIG. 6 is an exploded view of yet another embodiment of a pool cover drain assembly.

FIG. 6 illustrates yet another embodiment of a drain assembly 24" identified with a "double prime" designation to distinguish the components of the drain assembly 24" of FIG. 6 from that of the drain assemblies 24, 24'. Unless otherwise described, the various features and description of the drain assembly 24 and/or 24' having the same reference numerals apply the drain assembly 24" of FIG. 6. While not illustrated some embodiments of the invention may include various combinations of the drain assemblies 24, 24', and 24".

The drain assembly 24" of FIG. 6 includes a drain cover 32" that is interconnectable with a basin 40" of the drain assembly 24". More particularly, the drain cover 32" includes a screen 33" (or other appropriate debris filter) and a base 35" that is designed to releasably connect with the support retainer 44 of the drain assembly 24" in a snap-on fashion or with an alternative fastening means such as screws. The screen 33" differs from the screen 33' in that the screen 33" includes a cord aperture 39 defined therein. In addition, the base 35" of the drain cover 32" has a cord channel 23 defined therein. While this cord channel 23 is defined in a side of the base 35", other embodiments of the drain cover 32" may have the cord channel 23 located in other appropriate locations on the base 35". Moreover, while the drain cover 32" includes both a cord aperture 39 and a cord channel 23, some embodiments of the drain cover 32" may include only one of the cord aperture 39 and the cord channel 23.

The basin 40" of the drain assembly 24" of FIG. 6 resembles the basin 40 shown in FIG. 3. However, disposed at least generally within the basin 40" of the drain assembly 24" is a water pump 88. This water pump 88 includes an electrical cord 90 that may pass through either the cord aperture 39 in the screen 33" or the cord channel 23 in the base 35", and may be interconnected with an appropriate power source (not shown). Accordingly, a portion of the cord 90 may be disposed on the top surface 26 of the pool cover 22 during use of the drain assembly 24". In addition, the water pump 88 is equipped with a switch 92 that may be activated to engage the pump 88 in any appropriate manner, such as by the water level in the basin 40" reaching or exceeding the level at which the switch 92 is located. Further, an appropriate pump hose 9 is attached to the pump 88 and fluidly interconnects the pump 88 and the out port 70 of the basin 40". Accordingly, this pump hose 94 is utilized as a conduit to enable water from the pump 88 to travel along an at least generally controlled path to the out port 70 of the basin 40". While the drain assembly 24" is shown as including the pump 88, other embodiments may include any appropriate pump utilizing any appropriate power source, such as batteries and/or solar power. One example of a pump that may be utilized as the pump 88 is the F-13 water pump manufactured by Tsurumi Pump of Osaka, Japan. Other embodiments of the basin 40" may exhibit other appropriate locations for the out port 70 of the basin 40" than that shown in FIG. 6. For instance, the out port of the basin 40" may be disposed at or toward the bottom 49" of the basin 40".

Still referring to FIG. 6, the basin 40" of the drain assembly 24" may exhibit any appropriate shape and/or dimensions. Moreover, the drain assembly 24" may include a dead weight 58 like that described in regard to FIG. 3, a weight assembly 53 like that described in relation to FIG. 5, and/or any other appropriate weighting feature to enable the drain assembly 24" to exhibit an appropriate weight to provide the drain assembly 24" with a weight density sufficient to position at least a portion of the drain cover 32" at or slightly below the water level 60 of the pool 12 when in use. Indeed, some embodiments may include a dead weight 58 or the like that is molded into the basin 40". However, some embodiments of the drain assembly 24" may not include a dead weight 58 or a weight assembly 53, such as if the weight density of the drain assembly 24" is already sufficient to position at least a desired portion the drain cover 32" at or below the water level 60 when in use without the inclusion of the weight assembly 53 or dead weight 58.

Incidentally, while the drain assemblies 24', 24" of FIGS. 5–6 are shown without associated drainage conduits 68, the description of the drainage conduit 68 relating to FIGS. 3–4 applies to at least one embodiment of each of the drain assemblies 24', 24" of FIGS. 5–6. Moreover, while the drain assembly 24" is shown without one or more gaskets 46, 46*a*, 46*b*, it should be noted that any appropriate number and location of gaskets may be employed as long as the pool cover 22 is at least generally disposed between the support retainer 44 and the basin 40.

Figure 7:
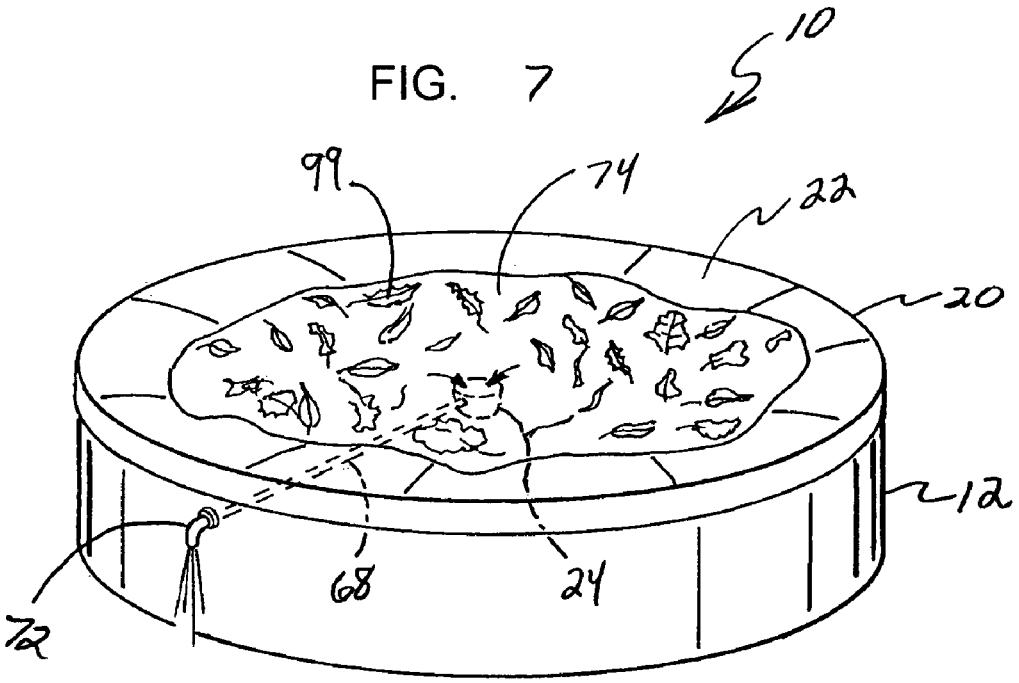
FIG. 7 is a perspective view of a pool assembly having an associated pool cover drain assembly to remove water from atop the pool cover.
Figure 8:
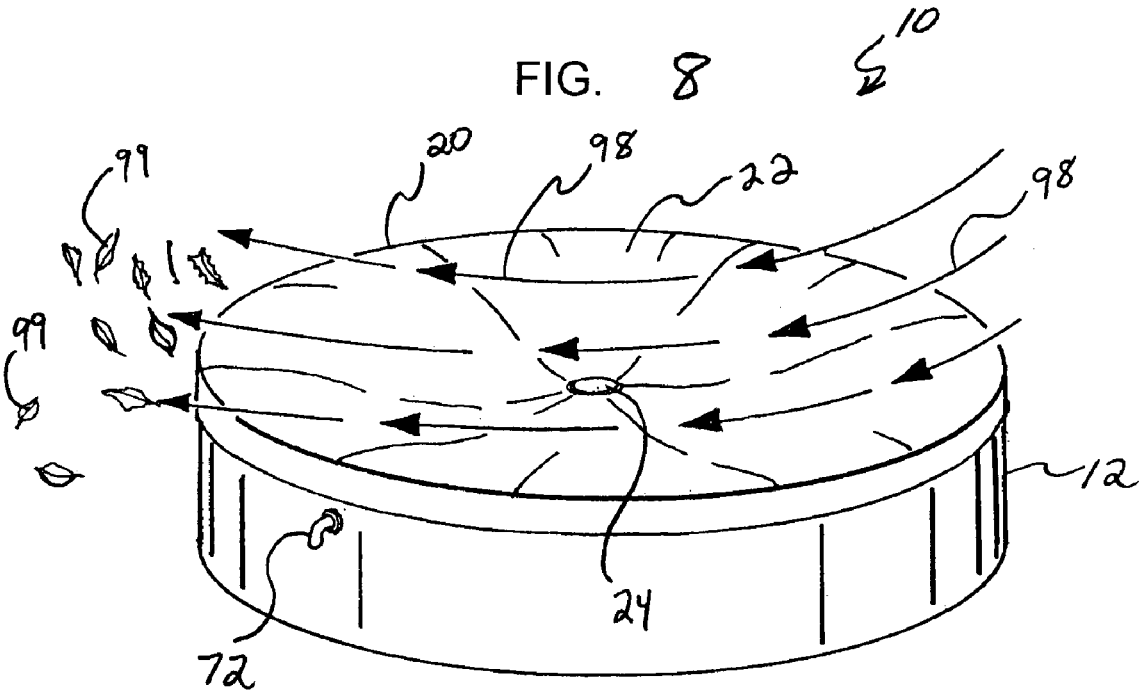
FIG. 8 is a perspective view of the pool assembly of FIG. 7 after the water has been removed from the pool cover.

Referring to FIG. 7, employment of the drain assembly 24, exhibiting a weight appropriate to position at least a portion of the drain cover 32 thereof at or below the water level 60 of the pool 12, in the pool cover assembly 20 enables the water 74 from atop the pool cover assembly 20 to travel in the general directions indicated by arrows 76 toward and into the drain assembly 24, through the drainage conduit 68, and out the port 72 of the pool 12. Referring to FIG. 8, upon an absence of any significant amounts of water 74 on the pool cover 22, an appropriate airflow 98 (e.g., from the wind, a leaf blower, or the like) may facilitate removal of debris such as leafs 99 from the pool cover assembly 20. Accordingly, use of the present invention may provide for increased use-life and/or reduced wear of the associated pool cover 22.

Those skilled in the art will now see that certain modifications can be made to the assemblies and related methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

What is claimed is:

1. A pool cover drain assembly, comprising:

a drain assembly wherein said drain assembly further comprises a basin, said basin having a base, at least one upstanding sidewall surrounding said base defining a fluid containing cavity, said upstanding sidewall terminating in a top of said basin, said top having an upward facing opening, and said basin further having a central longitudinal reference axis extending upward from said base through said upward facing opening;

a support retainer disposed over said top of said basin and having a central aperture extending therethrough; said aperture having a perimeter generally aligned with said upward facing opening of said basin to form a throughway; and a debris filter interposed generally across said throughway; and a flexible pool cover, said pool cover having an aperture extending therethrough, said aperture having a shape similar to said upward facing opening of said basin and said pool cover having a top surface and an opposing bottom surface;

said support retainer being detachably attached to said top of said basin whereby at least a portion of said pool cover adjacent to said aperture is disposed between said support retainer and said top of said basin, said support retainer being located above said top surface of said pool cover and said top of said basin being located below said bottom surface of said pool cover.

2. A pool cover assembly, as claimed in claim 1, further comprising:

a first gasket and a second gasket wherein said first gasket is disposed between said support retainer and said top surface of said pool cover and said second gasket is disposed between said top of said basin and said bottom surface of said pool cover.

3. A pool cover drain assembly, as claimed in claim 2, wherein:

said debris filter is disposed within said aperture of said pool cover.

4. A pool cover drain assembly, as claimed in claim 3, wherein:

at least a portion of said debris filter extends below said aperture in said pool cover and is disposed beyond said bottom surface of said pool cover; and at least a portion of said debris filter extends above said aperture in said pool cover and is disposed beyond said top surface of said pool cover.

5. A pool cover drain assembly, as claimed in claim 4, wherein:

said debris filter is removably attached to said basin.

6. A pool cover drain assembly, as claimed in claim 5, wherein:

said debris filter further comprises a substantially flat top surface and at least one sidewall, said sidewall having a plurality of drainage holes.

7. A pool cover drain assembly, as claimed in claim 6, further comprising:

a drainage conduit connected to said basin.

8. A pool cover drain assembly, as claimed in claim 7, further comprising:

a dead weight;

said dead weight being disposed within said basin and said dead weight having a sufficient weight to cause said drain assembly to exhibit a weight density substantially equal to or greater than water.

9. A pool cover drain assembly, as claimed in claim 2, wherein:

said debris filter is a screen and said debris filter is releasably attached to said support retainer.

10. A pool cover drain assembly, as claimed in claim 9, wherein:

said screen has a convex side directed away from said top surface of said pool cover.

11. A pool system, comprising:

a pool having a floor and at least one sidewall; and a drain assembly wherein said drain assembly further comprises a basin, said basin having a base, at least one upstanding sidewall surrounding said base defining a fluid containing cavity, said upstanding sidewall terminating in a top of said basin, said top having an upward facing opening, and said basin further having a central longitudinal reference axis extending upward from said base through said upward facing opening;

a support retainer disposed over said top of said basin and having a central aperture extending therethrough; said aperture having a perimeter generally aligned with said upward facing opening of said basin to form a throughway; and a debris filter interposed generally across said throughway; and a flexible pool cover, said pool cover having an aperture extending therethrough, said aperture having a shape similar to said upward facing opening of said basin and said pool cover having a top surface and an opposing bottom surface;

said support retainer being detachably attached to said top of said basin whereby at least a portion of said pool cover adjacent to said aperture is disposed between said support retainer and said top of said basin, said support retainer being located above said top surface of said pool cover and said top of said basin being located below said bottom surface of said pool cover.

12. A pool system, as in claim 11, further comprising:

a dead weight;

said dead weight being disposed within said basin of said drain assembly and said dead weight having a sufficient weight to cause said drain assembly to exhibit a weight density substantially equal to or greater than water; and a drainage conduit connected to said basin.

13. A pool system, as claimed in claim 12, further comprising a port in said at least one sidewall of said pool, said port being located a first distance above said floor of said pool wherein said basin of said drain assembly is located a second distance above said floor of said pool, said second distance being greater than said first distance, and said drainage conduit interconnects said basin and said port.

* * * * *